US011339455B2

(12) United States Patent
Clin et al.

(10) Patent No.: US 11,339,455 B2
(45) Date of Patent: May 24, 2022

(54) SECTION AND METHOD FOR COOLING A CONTINUOUS LINE COMBINING DRY COOLING AND WET COOLING

(71) Applicant: FIVES STEIN, Maisons Alfort (FR)

(72) Inventors: Michel Clin, Maisons-Alfort (FR); Florent Code, Maisons-Alfort (FR); Loïc Philippe, Maisons-Alfort (FR); Eric Magadoux, Maisons-Alfort (FR)

(73) Assignee: FIVES STEIN

( * ) Notice: Subject to any disclaimer, the term of this patent is extended or adjusted under 35 U.S.C. 154(b) by 241 days.

(21) Appl. No.: 16/496,115

(22) PCT Filed: Mar. 22, 2018

(86) PCT No.: PCT/FR2018/050706

§ 371 (c)(1),
(2) Date: Sep. 20, 2019

(87) PCT Pub. No.: WO2018/172714

PCT Pub. Date: Sep. 27, 2018

(65) Prior Publication Data

US 2020/0095652 A1 Mar. 26, 2020

(30) Foreign Application Priority Data

Mar. 22, 2017 (FR) ..... 1752353

(51) Int. Cl.

| | |
|---|---|
| ***C21D 9/573*** | (2006.01) |
| ***C23C 2/02*** | (2006.01) |
| ***C21D 1/60*** | (2006.01) |
| ***C21D 1/613*** | (2006.01) |
| ***C21D 11/00*** | (2006.01) |
| *C23C 2/40* | (2006.01) |

(52) U.S. Cl.

CPC ..... *C21D 9/573* (2013.01); *C21D 1/60* (2013.01); *C21D 1/613* (2013.01); *C21D 11/005* (2013.01); *C23C 2/02* (2013.01); *C23C 2/40* (2013.01)

(58) Field of Classification Search

None

See application file for complete search history.

(56) References Cited

U.S. PATENT DOCUMENTS

| | | | | |
|---|---|---|---|---|
| 2013/0029055 | A1 | 1/2013 | Delaunay et al. | |
| 2014/0350746 | A1 | 11/2014 | Lee et al. | |
| 2016/0355903 | A1 * | 12/2016 | Kwak | C21D 9/573 |

FOREIGN PATENT DOCUMENTS

| | | | | |
|---|---|---|---|---|
| JP | 60251230 | A * | 12/1985 | C21D 9/573 |
| JP | 2002309359 | A * | 10/2002 | |
| WO | WO2010049600 | | 5/2010 | |
| WO | WO2010049600 | A1 | 5/2010 | |

(Continued)

OTHER PUBLICATIONS

International Search Report from PCT/FR2018050706, dated Jun. 5, 2018, pp. 1-6.

*Primary Examiner* — Scott R Kastler

(74) *Attorney, Agent, or Firm* — The Belles Group, P.C.

(57) ABSTRACT

Cooling section for a steel strip continuous annealing or galvanizing line arranged to handle a metal strip (1), said section comprising at least one area (2) for dry cooling set up to project gas on said steel strip and at least one wet cooling area (5) set up to project a liquid or a mixture of gas and liquid on said steel strip.

6 Claims, 2 Drawing Sheets

(56) References Cited

FOREIGN PATENT DOCUMENTS

| | | | | |
|---|---|---|---|---|
| WO | WO2011004302 | | 1/2011 | |
| WO | WO2011004302 | A1 | 1/2011 | |
| WO | WO-2016001701 | A1 * | 1/2016 | ..... C21D 9/60 |
| WO | WO2016001701 | A1 | 1/2016 | |

* cited by examiner

SECTION AND METHOD FOR COOLING A CONTINUOUS LINE COMBINING DRY COOLING AND WET COOLING

CROSS-REFERENCE TO RELATED PATENT APPLICATIONS

The present application is a U.S. national stage application under 35 U.S.C. § 371 of PCT Application No. PCT/FR2018/050706, filed Mar. 22, 2018, which claims priority to French Patent Application No. 1752353, filed Mar. 22, 2017. The disclosures of the aforementioned priority applications are incorporated herein by reference in their entireties.

The invention relates to cooling sections for continuous annealing or galvanizing lines for strip steel.

By galvanizing, this description intends all dip-coating, whether the coating is of zinc, aluminum, alloys of zinc and aluminum, or any other type of coating. The invention relates in particular to the rapid cooling sections of these lines.

In a steel strip continuous annealing or galvanizing line, a steel strip runs through various sections within which it undergoes thermal processing, including phases where it is heated, cooled, or its temperature is maintained.

The cooling phase of the steel strips is particularly critical. It is the cooling phase that chiefly determines the final mechanical and metallurgical properties of the steel strip. Depending on the cooling rate and chemical composition of the steel strip, various metallurgical phases may be created, thereby establishing different mechanical properties for the strip.

An ideal cooling section should enable the steel strip to be cooled perfectly uniformly across its entire width, so as to guarantee the uniformity of the final strip's mechanical and metallurgical properties. This cooling section should also be able to apply different cooling rates, so as to be able to produce most types of steel.

There are two major families of steel strip cooling technology used on continuous annealing or galvanizing lines, or continuous lines that combine annealing and galvanizing: gas cooling and wet cooling.

Gas cooling, which typically involves projecting a high-speed, high hydrogen-content mix of $N_2H_2$ on the steel strip, can achieve cooling speeds of up to 200° C./s for strips 1 mm thick. Since this process uses a reducing gas, the steel strip is not oxidized after passing through a cooling section that uses this type of technology. The strip can then be galvanized without the need for any other intermediate step of a chemical nature. However, since cooling rates are limited to 200° C./s, this process cannot produce steels with the advanced mechanical and metallurgical properties that require higher cooling rates.

An aim of the invention is to propose a cooling section that provides more flexibility than cooling sections in the state of the art.

This aim is achieved, according to a first element of the invention, with a cooling section for a steel strip continuous annealing or galvanizing line set up to handle a metal strip, said section comprising at least one area for dry cooling set up to project gas on said steel strip and at least one wet cooling area set up to project a liquid or a mixture of gas and liquid on said steel strip.

The dry cooling area may include blowing boxes arranged to project the gas on the steel strip. The gas may be a mixture of nitrogen and hydrogen.

The wet cooling area may include nozzles arranged to project the liquid or mixture of gas and liquid on the steel strip. The liquid may be water, an acid solution, or any other solution.

The cooling section as per the invention can produce steels with advanced mechanical properties which can be directly subjected to a galvanizing stage on exiting said section, without needing an intermediate chemical treatment.

The wet cooling area can achieve cooling rates of the order of 1000° C./s for a steel strip 1 mm thick.

The cooling section as per the invention also enables successive dry cooling and wet cooling without needing to cut the strip to bypass one of the cooling areas. The gain in productivity is significant.

The dry and wet cooling areas can operate at the same time and/or separately. The ability to operate these two methods alternately or successively make the cooling section as per the invention extremely flexible to use for the different types of steel strip to be included in the continuous line's product mix.

The wet cooling area may include an immersion cooling area.

Advantageously, the wet cooling area is preferably a cooling area using a liquid spray. A liquid spray area may easily and quickly be brought to a halt. Moreover, spray cooling enables easy control of the steel strip's temperature at the end of cooling, and so its mechanical and metallurgical properties.

In one arrangement, the wet and dry cooling areas are set up, respectively, in one vertical direction and a second vertical direction parallel to the first. Experts usually identify this configuration as a two pass arrangement. With this arrangement, the wet cooling area may be positioned upstream, in terms of the steel strip running through the cooling section, or downstream of the dry cooling area.

Alternatively, the wet and dry cooling areas are arranged in the same vertical direction. Experts usually identify this alternative configuration as a one pass arrangement.

With this variant the dry cooling area may be located beneath the wet cooling area. In this case, a drying system for the steel strip may be placed between the wet cooling area and the dry cooling area.

Alternatively, with this variant, the wet cooling area may advantageously be located beneath the dry cooling area. This arrangement makes the cooling section more compact, with no need for a drying system between the dry cooling area and the wet cooling area.

Advantageously, the cooling section as per the invention may also include an atmosphere separation seal between the dry cooling area and the wet cooling area. The separation seal prevents the wet cooling area being contaminated by different gaseous species from the dry cooling. The separation seals prevent the creation of a mixing area of the atmospheres of these two areas, avoiding a potentially dangerous combination, particularly when the gas cooling mix has a high hydrogen content.

Atmosphere separation between two areas of a furnace can be achieved with a seal with two pairs of rolls, or equally two pairs of shutters, with extraction between the pairs.

In a particular feature of the invention, the atmosphere separation seal may comprise three pairs of rolls, each of the pairs set transversely to the metallic strip running direction, said three pairs of rolls creating between them two areas within the said seal, respectively a first area between the first two pairs of rolls in the strip running direction and located on the dry cooling side with means of extraction, and a second area between the two last pairs of rolls in the strip running direction and located on the wet cooling side with means to inject an inert gas. This creates a buffer area between the first two pairs of rolls and a system for atmosphere extraction between the last two pairs of rolls. Leaks of inert gas, from the buffer area towards the wet cooling area and the extraction area do not create problems. The pairs of rolls can be replaced with shutters. As well as atmosphere separation, this seal advantageously creates a "clean" area where the strip's temperature can be measured across its width, using a scanner for example, or at a point, using a pyrometer for instance. This temperature measurement can allow to better regulate the strip's cooling process.

In one arrangement, the cooling section may also include a drying and purging system for the wet cooling area. Advantageously, this drying and purging system may be implemented when the wet cooling area is not used to cool the strip. Advantageously, this drying and purging system helps limit transition times, according to the continuous line's thermal cycles and product mix, between a product that requires the use of the wet area and a product that does not need to be cooled by the wet area. Indeed, if the wet area remained wet, the degraded dew-point could lead to poor surface condition of the strip as it passes through it.

In one possibility the drying and purging system of the wet cooling area may include equipment arranged to inject nitrogen, preferably heated, preferably to 50° C., for purging the wet area. The nitrogen can be heated in advance, for example using heat captured from the fumes of the heating areas of the continuous line. Drying of the wet area is improved.

To improve drying and purging times, two additional devices may be included.

The drying and purging system may include equipment arranged to heat the walls of the wet cooling area. This makes it possible to limit condensation in the wet cooling area, or to reduce the drying time of the wet area. Preferably, the heating takes place through the addition of elements that heat by conduction or radiation. These can be placed inside or outside the walls.

The drying and purging system may include a system of nitrogen knives directed downwards in the wet cooling area and arranged to blow nitrogen at the interior walls of the wet cooling area. This nitrogen knives system enables better removal of liquid from the walls of the wet cooling area.

A second aspect of the invention proposes a cooling process for a steel strip continuous annealing or galvanizing line arranged to handle a metal strip, said process comprising at least one dry cooling stage with gas projected on the steel strip and at least one wet cooling stage with a liquid or a mixture of gas and liquid projected on the steel strip.

Advantageously, with the invention, the liquid can be non-oxidant for the strip. It can be a solution of formic acid at an acid concentration of between 0.1% and 6% by mass of the solution, and advantageously between 0.5% and 2% by mass of the solution.

The process according to the second aspect of the invention may also include an atmosphere separation stage, using an atmosphere separation seal, placed between the dry cooling area and wet cooling area, said separation stage including an inert gas injection stage in a first area of the seal and an extraction stage in a second area of the seal.

The process according to the second aspect of the invention may also include a drying and purging stage of the wet cooling area, preferably using heat captured from a heating area in the continuous line. For example, energy can be captured from the fumes of the heating areas of the continuous line.

The cooling section as per the first aspect of the invention may include control systems, preferably computer control systems, configured for the cooling section as per the first aspect of the invention, or one of its improvements, for example for activating one or other or both of the dry and wet cooling areas, depending on the product to be cooled.

A third aspect of the invention proposes a computer program product, downloadable from a communication network and/or stored on media that can be read by a computer and/or executed by a microprocessor, and loadable to the internal memory of a calculating unit, characterised by containing programming code instructions which, when executed by the calculating unit, initiate the stages of the process according to the second aspect of the invention or one of its improvements.

The invention consists, besides the provisions described above, of a certain number of other provisions which will be more explicitly addressed hereafter, with reference to assembly examples described in relation to the attached drawings, but which are in no way limiting. On these drawings.

Figure 1:
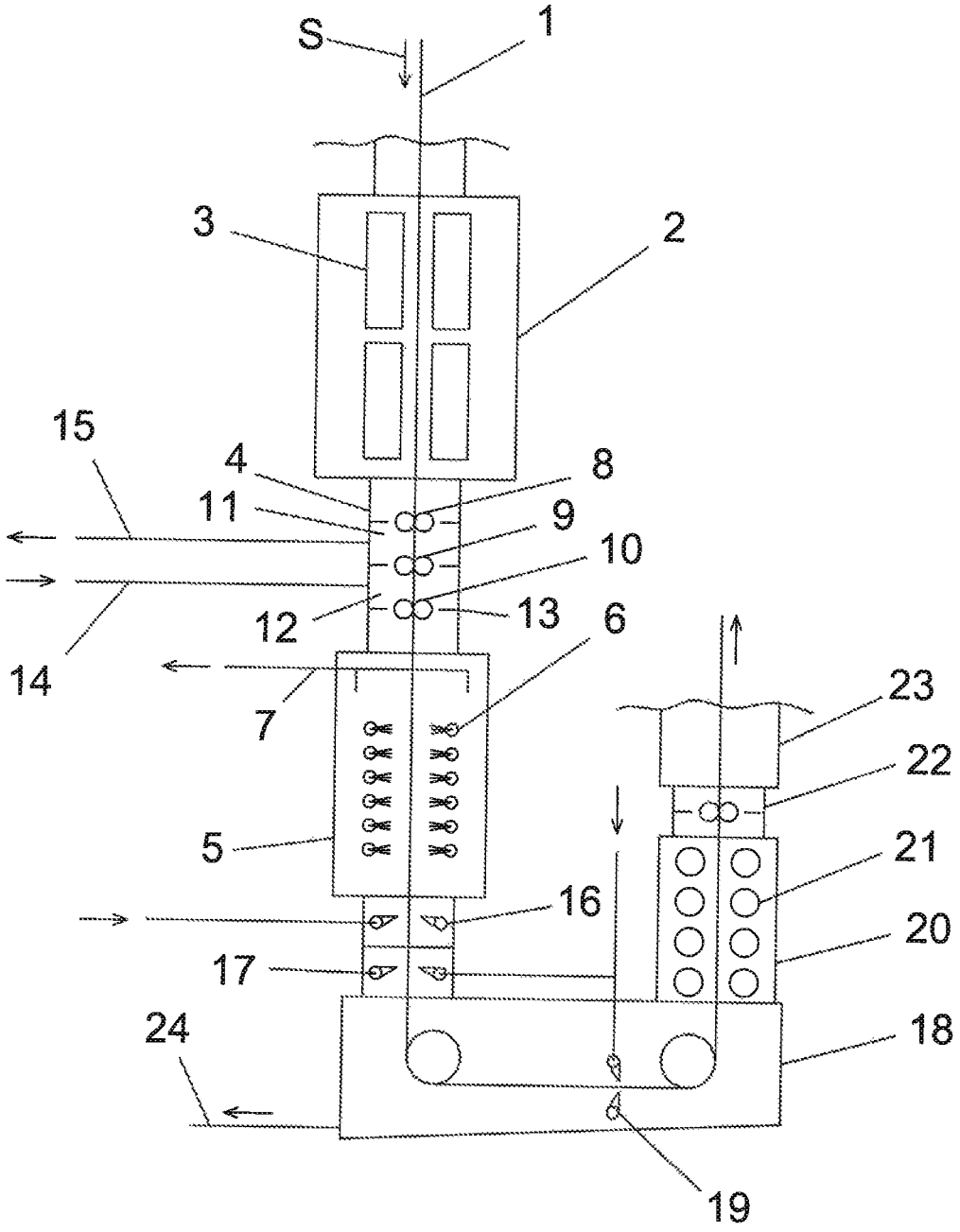
FIG. 1 is a schematic view of a cooling section, in a first arrangement of the invention, from a continuous strip processing line.

The attached FIG. 1 diagram shows a cooling section, as per the first arrangement, for a continuous annealing or galvanizing line for metal strips, set up to receive a metal strip 1 with a running direction S, successively combining, in the running direction, at least one dry cooling area 2 and one wet cooling area 5.

In the example shown, the cooling section also includes an atmosphere separation seal 4, separating the dry cooling area 2 and the wet cooling area 5.

The strip 1 enters the cooling section running downwards in the direction S. It passes first through the dry cooling area 2 where a mixture of nitrogen and hydrogen is projected on the strip using blowing boxes 3. The strip then passes through the atmosphere separation seal 4 before entering the wet cooling area 5.

The wet cooling area 5 has nozzles 6 arranged to project a cooling fluid on the metal strip 1.

The wet cooling area 5 includes vapor extraction 7, which in the example shown in the figure is located in the upper section of the wet cooling area 5.

The atmosphere separation seal 4 located between the dry area 2 and the wet area 5 comprises three successive pairs 8, 9 and 10 of rolls, in the running direction S of the metal strip 1. Each of the pairs is set transversely to the running direction of the metal strip.

Between them, the three pairs delimit two successive areas 11 and 12 of the seal, in the running direction of the strip. Area 11, delimited by roll pairs 8 and 9 is located on the side of the dry cooling area 2; area 12, delimited by roll pairs 9 and 10 is located on the wet cooling area side.

The rolls rotate at the strip running speed. They are kept in contact with the strip, or in a position of immediate proximity to the strip.

Behind and beside the rolls, a mechanism 13 limits the circulation of gas between the areas of the seal, particularly by limiting the space between fixed and moving parts.

An injection of nitrogen is made into area 12 by means of a supply 14 that is a device arranged to inject inert gas.

Extraction takes place in area 11 using an extraction device 15. The pressure and injection flow rate of the inert gas into area 12 and the extraction flow from area 11 are set so that the flow of gas between areas 11 and 12 takes place solely from area 12 towards area 11. This prevents wet atmosphere from the wet area 5 entering area 11 of the seal and any mixing with the dry atmosphere of area 2.

In the example shown, at the exit of the wet cooling area 5, in the strip running direction, there is a set 16 of liquid knives for removing the majority of run-off liquid from the strip. The set 16 of liquid knives is followed by a set 17 of gas knives for removing the remainder of the liquid from the strip.

Still referring to the first arrangement, the metal strip 1 then passes through a return tank 18 where the cooling liquid projected by the nozzles 6 and the liquid knives 16 is collected before being sent to a recirculation tank (not shown) via a duct 24.

The return tank 18 includes a second set 19 of gas knives to remove any remaining liquid from the metal strip 1.

In the example shown, the first set 17 and the second set 19 of gas knives are fed from supplies coming from the same supply duct (not numbered) shown with a vertical arrow.

The metal strip 1 then passes through an area 20 where heating tubes 21 eliminate all traces of liquid on the strip. On leaving this area 20, the strip passes through an atmosphere separation seal 22 between wet areas 5, 18, 20 and areas 23 downstream in the strip running direction.

For example, the strip is cooled in the dry area 2 from a temperature of 800° C. to a temperature of 700° C., and is then cooled in the wet area 5 from a temperature of 700° C. to temperature of 460° C.

The cooling liquid is for example water, or an acid solution containing formic acid.

Figure 2:
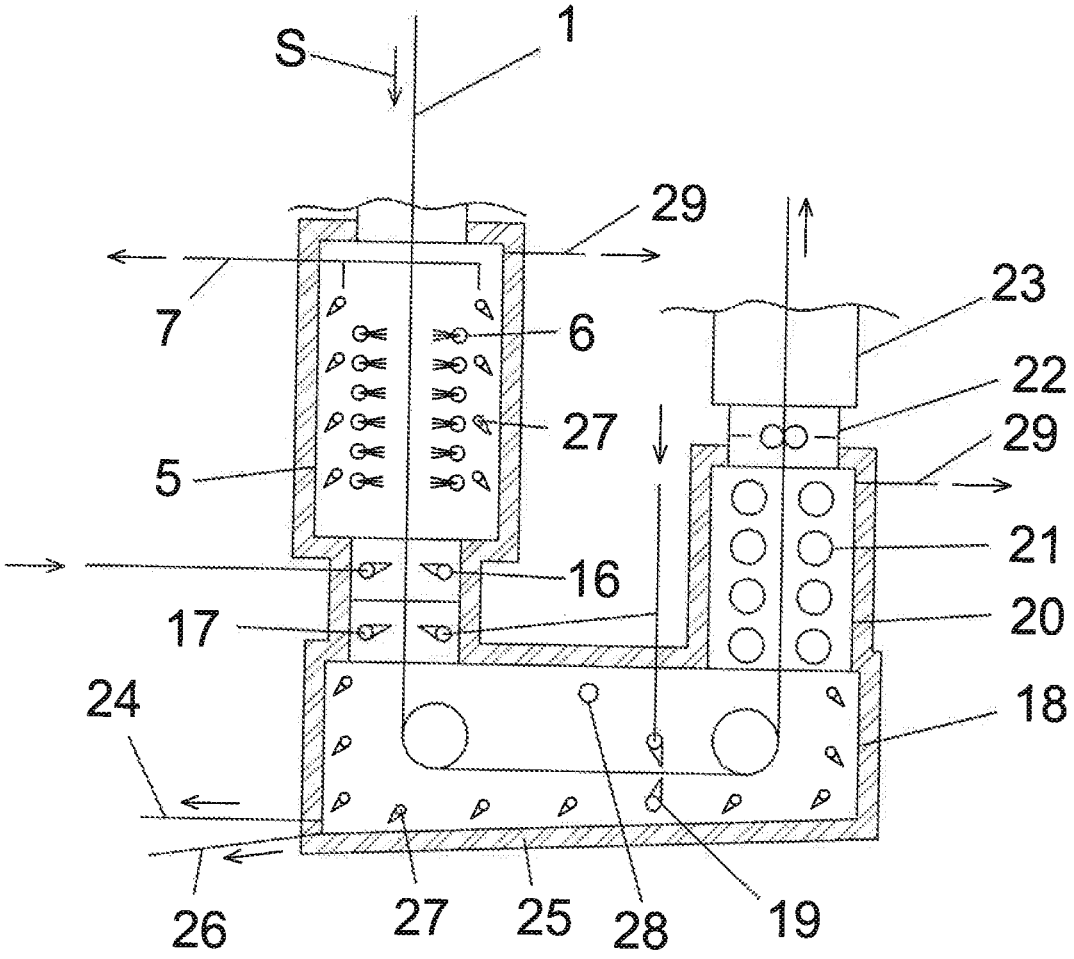
FIG. 2 is a schematic view of a cooling section, in a second arrangement of the invention, showing a drying and purging system for the wet cooling area.

The attached FIG. 2 diagram shows a second arrangement for a system as per the invention, described only for its differences from the first arrangement.

The second arrangement also includes a drying and purging system for the inventions' wet cooling area.

The drying and purging system for the wet cooling area comprises inert gas knives 27, of nitrogen for example, directed downwards and blowing on the interior walls of a casing within the wet cooling area, to help evacuate the liquid from the walls towards a recirculation duct 24 or a purge duct 26.

As well as the inert gas introduced by the knives 27, the drying and purging system of the cooling area in the second arrangement includes inert gas injection points 28, for example nitrogen, and vents 29 for a rapid purge of the wet cooling area 5. The inert gas feeding the knives 27 and injection points 28 is heated in advance, for example to a temperature of around 50° C.

A heating and thermal insulation system 25 of the casing walls for the wet cooling area is installed outside the walls of the wet cooling area.

Advantageously, the liquid directed onto the strip is a solution of formic acid, with a concentration of between 0.1% and 5.5%, advantageously between 0.1% and 5%, advantageously between 0.1% and 4.5%, advantageously between 0.1% and 4%, advantageously between 0.1% and 3.5%, advantageously between 0.1% and 3%, advantageously between 0.1% and 2.5%, advantageously between 0.15% and 2.5%, advantageously between 0.2% and 2.5%, advantageously between 0.3% and 2%, advantageously between 0.35% and 2.5%, advantageously between 0.4% and 2.5%, advantageously between 0.45% and 2.5% by mass of the solution. More advantageously, the solution has a concentration of formic acid between 0.46% and 2.4%, advantageously between 0.47% and 2.3%, advantageously between 0.48% and 2.2%, advantageously between 0.49% and 2.1% by mass of the solution. Even more advantageously, the solution has a concentration of formic acid between 0.5% and 2% by mass of the solution.

Of course, the invention is not limited to the examples described above and numerous adjustments can be made to these examples without moving outside the frame of the invention. Moreover, the invention's various characteristics, forms, variants and assembly methods can be linked to one another in different combinations to the extent that they remain compatible and do not exclude each other.

The invention claimed is:

1. Cooling section for a steel strip continuous annealing or galvanizing line arranged to handle a metal strip (1), said section comprising:

at least one area (2) for dry cooling set up to project gas on said steel strip;

at least one wet cooling area (5) set up to project a liquid or a mixture of gas and liquid on said steel strip; and an atmosphere separation seal (4) between the dry cooling area and the wet cooling area, the atmosphere separation seal (4) comprising:

three pairs of rolls (8, 9, 10), each of the three pairs set transversely to the metal strip running direction, the three pairs of rolls creating between them two areas within the said seal, respectively a first area (11) between a first roll pair of the two pairs of rolls (8, 9) in the strip running direction and located on the dry cooling area (2) side with means of extraction (15), and respectively a second area (12) between a second roll pair of the two pairs of rolls (9,10) in the strip running direction and located on the wet cooling area (5) side with means (14) to inject an inert gas.

2. Cooling section as per claim 1, where the dry cooling area and wet cooling area are arranged in a vertical pass, the wet cooling area being located beneath the dry cooling area.

3. Cooling section as per claim 1, also including a drying and purging system (24, 25, 26, 27, 28, 29) of the wet cooling area.

4. Cooling section as per claim 3, where the drying and purging system of the wet cooling area includes equipment (27, 28) arranged to inject nitrogen.

5. Cooling section as per claim 3, where the drying and purging system of the wet cooling area includes equipment (25) arranged to heat the walls of said wet cooling area.

6. Cooling section as per claim 3, where the drying and purging system of the wet cooling area includes a system of nitrogen knives directed downwards in the wet cooling area and arranged to blow nitrogen at the interior walls of the wet cooling area.

* * * * *